United States Patent [19]

Rao et al.

[11] 4,036,372

[45] July 19, 1977

[54] EXTENSION AND RETRACTION MEANS FOR THE TELESCOPIC BOOM ASSEMBLY OF A CRANE

[75] Inventors: Kamlaker P. Rao, Aurora; William L. Lowe, Naperville; O. Thomas Nephew, Geneva, all of Ill.

[73] Assignee: Clark Equipment Company, Buchanan, Mich.

[21] Appl. No.: 641,191

[22] Filed: Dec. 15, 1975

[51] Int. Cl.[2] ..... B66C 23/70

[52] U.S. Cl. ..... 212/144; 52/118; 212/46 B; 212/55

[58] Field of Search ..... 212/33, 46 B, 55, 57, 212/64, 59 R, 144; 52/114, 115, 117, 118, 121; 187/9 E; 343/883, 902

[56] References Cited

U.S. PATENT DOCUMENTS

| | | | |
|---|---|---|---|
| 3,361,456 | 1/1968 | Durand | 52/118 X |
| 3,631,988 | 1/1972 | Noly | 212/144 X |
| 3,670,465 | 6/1972 | Cheze | 52/115 |
| 3,688,455 | 9/1972 | Zebuhr | 52/115 |
| 3,738,075 | 6/1973 | Nansel | 52/118 X |

FOREIGN PATENT DOCUMENTS

| | | | |
|---|---|---|---|
| 1,217,041 | 5/1966 | Germany | 212/55 |

*Primary Examiner*—Robert J. Spar

*Assistant Examiner*—Carl Rowold

*Attorney, Agent, or Firm*—Harry G. Thibault

[57] ABSTRACT

Means for extending and retracting the telescoping boom assembly of a rotatable mobile crane wherein the boom assembly comprises a plurality of telescoping parts, slidably received one into the other. The boom extension and retraction means is operable at any angular displacement of the boom assembly, the operating angle of the boom assembly being maintained during the extension or retraction thereof. Means for extending and retracting the boom assembly include a single fluid driven linear motor or hydraulic cylinder suitably attached at one end portion of the motor to a base portion of the boom assembly. An opposite end portion of the linear motor is selectively securable to the telescoping sections of the boom assembly to permit extension thereof. A cylinder guide is mounted on the fluid driven linear motor, both the cylinder guide and motor contained within the boom assembly, the cylinder guide providing support for the linear motor and maintaining the alignment of the extension and retraction means. The extension and retraction means also includes a single latch mechanism comprising first latching means for extension and retraction of the telescoping boom sections of the boom assembly, and second latching means for locking the boom assembly in position.

17 Claims, 12 Drawing Figures

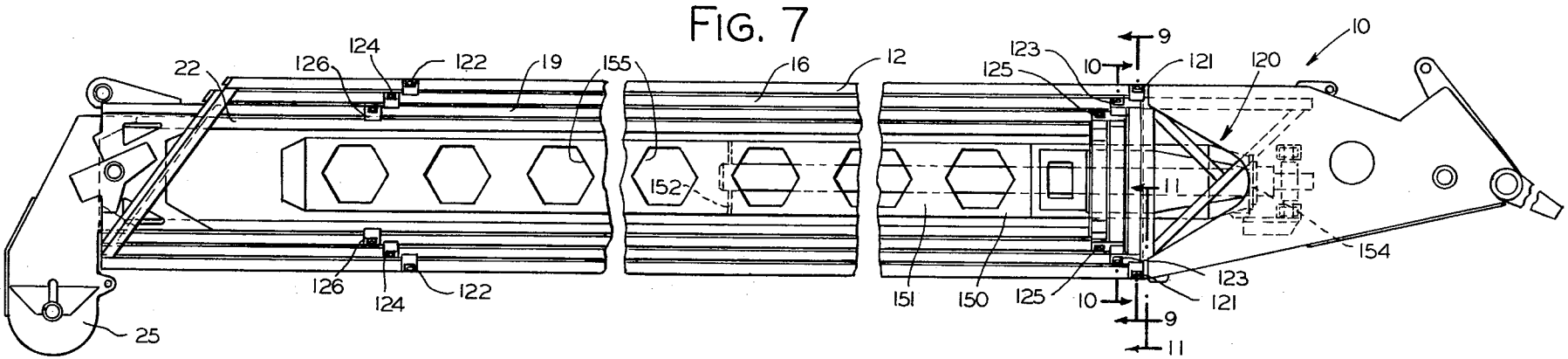
FIG. 7
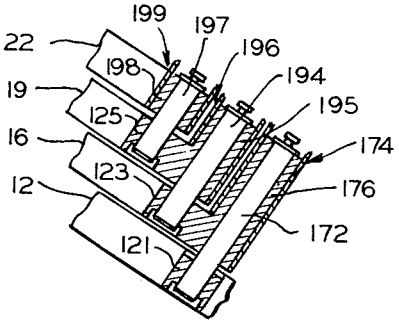
FIG. 12
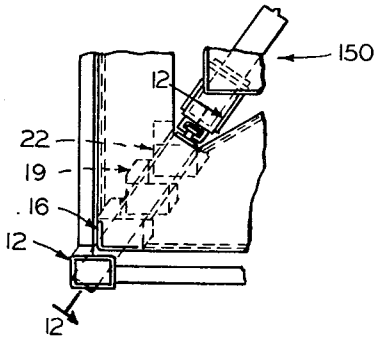
FIG. 11
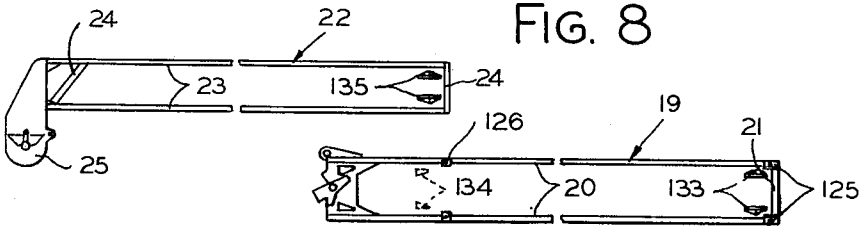
FIG. 8
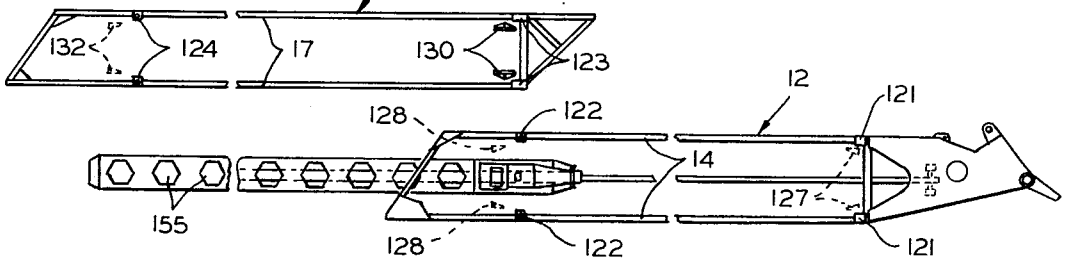

EXTENSION AND RETRACTION MEANS FOR THE TELESCOPIC BOOM ASSEMBLY OF A CRANE

BACKGROUND OF THE INVENTION

1. Field of the Invention

This invention relates to large material handling systems; more particularly, it relates to a means for extending and retracting a crane boom assembly mounted on a superstructure of a mobile crane.

A large mobile crane of the type with which the present invention is concerned typically includes a telescoping boom assembly having two or more extensible and retractable boom sections nested within a non-extensible boom base section which is pivotally mounted on the superstructure of the crane. In operation, the boom assembly is mounted on the superstructure for rotation about a horizontal axis and may be rotated to lock at a potentially infinite number of inclined working positions which range from 0° to 80° C with respect to the horizontal. The amount of extension of the boom assembly and the angle of inclination determine the height between which loads may be raised or lowered by the boom assembly. Typically, the boom assembly operates with the telescoping sections fully extended to increase the working height of the boom.

2. Known Systems

The boom assembly is generally extended and can be retracted by linear motors or hydraulic cylinders operatively connected between adjacent sections of the telescoping boom assembly.

For example, many boom extension and retraction means require that a linear motor be placed between each adjacent pair of telescoping boom sections to insure full extension of the boom assembly. This requirement adds substantial weight to the completed boom assembly, thus greatly increasing the bending stresses acting on the boom assembly, and severely reducing the overall operating capacity of the crane.

Those few systems which use a single fluid driven cylinder to extend a plurality of telescoping boom sections, must be vertically oriented for extension, retraction and operation of its boom assembly. For example, a tower crane operates at substantially lower load levels and smaller operating radii than the cranes of the present invention. Bending loads on the tower itself are minimal and the cylinder does not contribute significantly to stresses exerted on the crane. Consequently, the weight of the hydraulic cylinder is not an important consideration in the design of tower cranes. Futher, such known boom assemblies provide substantial overlap between adjacent telescoping sections.

Latch mechanisms for an extensible crane boom assembly can range from the very unsophisticated to the relatively complex and can include latching means at both top and bottom of each interconncected telescoping section.

Means and apparatus for extending and retracting the telescoping boom assembly of a mobile crane should comprise a single lightweight cylinder to minimize the bending stresses exerted on the boom assembly by the extension and retraction apparatus and should include a latch mechanism having positive locking for the extended boom sections of the boom assembly, permitting selective extension of various of the sections of the boom assembly, providing guide means for the extension and retraction apparatus of the boom assembly to insure the reliability of the locking means for the extension and retraction apparatus, the mechanism comprising single latching means and utilizing a minimum number of operating parts.

The object of the present invention is to provide an improved apparatus for the extension and retraction of the telescoping boom assembly of a mobile material handling crane wherein the apparatus permits extension and retraction at any angular displacement of the boom assembly and a single fluid driven power cylinder may be used to selectively extend and retract the plurality of telescoping boom sections of the boom assembly.

A further object of the present invention is to provide an improved single latch mechanism including first means for engagement and disengagement of the locking means associated with each of the boom sections of the boom assembly and second means for extension and retraction of the boom assembly, both means being commonly aligned on the latch mechanism.

Another object of the present invention is to provide positive locking means between adjacent sections of the telescoping boom assembly.

Another object of the present invention is to provide guide means associated with the fluid driven power cylinder to insure that the positive locking means are properly aligned with the boom sections of the telescoping boom assembly to insure positive locking between adjacent sections of the boom assembly.

SUMMARY OF THE INVENTION

In the present invention, the boom assembly is pivotally mounted on the superstructure of a crane at a lower end portion thereof for movement about a horizontal axis to an inclined working position.

The boom assembly comprises a plurality of boom sections correspondingly proportioned so that they slide telescopically in each other to provide a boom of appropriate working length. A fluid driven linear motor or hydraulic cylinder is pinned at the outer end of the rod portion thereof to the base of outermost or boom base section of the boom assembly. Suitably attached to the cylinder portion of the linear motor and enclosing same is a cylinder guide having a central core which is rectangular in cross-section, the cylinder guide and its associated cylinder nested within the innermost of the telescoping boom sections.

The preferred embodiment of the present invention includes a hydraulically actuated latch mechanism comprising a lower frame assembly including a pair of cross plates provided at the rear end of the central core of the cylinder guide and which extend transverse the width thereof to intersect respective upper and lower portions of the central core. The cross plates are welded in place. Cantilever mounted on the cross plates outside the central core of the cylinder guide portion of the mechanism are a first plurality of boom latching pin cylinder mechanisms and a second plurality of chord pin cylinder mechanisms. A pair of latching pin cylinder mechanisms are mounted on each cross plate on opposite sides of the central core of the cylinder guide and oriented to extend outwardly, toward the boom assembly. Respective latching pins are appropriately secured to the outer ends of the latching pin cylinder mechanisms. A pair of chord pin cylinder mechanisms also are mounted on each cross plate on opposite sides of the central core of the cylinder guide and outboard of the latching pin cylinder mechanisms. Respective outer ends of the chord pin cylinders have gripping means mounted thereon to engage head portions of associated chord pins mounted in each pair of adjacent telescoping sections to lock the sections in the fully retracted position.

In the fully retracted position two adjacent telescoping sections of the boom assembly are held together at respective rear portions thereof by a set of four chord pins, an upper pair extending outwardly to be received in respective upper rear portions of the telescoping sections and a lower pair extending outwardly to be received in respective lower rear portions of the telescoping sections. Each pair of pins is symmetrically located with respect to the vertical centerline of the booms' cross sections, and also vertically aligned with a corresponding pin of the other pair.

The inner of two adjacent telescoping sections includes a framework at its rear or lower end, for receiving the boom chord pins. The structure of each boom section includes four main load bearing members or chords at the four corners of the boom section. These members are longitudinally co-extensive for the length of the boom section. The boom chords are held together by lacings, which are transverse members extending between adjacent chords of the boom section to hold the chords in place. At the lower end of the inner boom section, an outside set of structural members or lacings extend between the chords. An inner frame structure is connected to the outer structure by retainer tubes associated with the boom chord pins and the latching pins. Two pairs of chord pin retainer tubes are welded in place to assemble the inner and outer structures of the inner boom section. Also welded between the inner and outer structure of the inner boom section are two pairs of latching pin retainer tubes, mounted inboard of the chord pin tubes. Inboard of the latching pin tubes the inner structure projects inward toward the center of the boom cross-section to form a cradle for the outer end of the central core of the cylinder guide. The latching pin retainer tubes and the chord pin retainer tubes are generally aligned with their corresponding mechanisms associated with the extension means.

A permanent sleeve for the chord pin is received in each of the chord pin tubes. The chord pin sleeve is co-extensive with the chord pin tube at its inner end but at the outer end of the chord pin sleeve a stepped shoulder engages the outer end of the chord pin tube, with the sleeve extending beyond the outer structure of the inner boom section.

In the outer section of the two adjacent telescoping boom sections, upper and lower plates or lacings extend between the upper pair of boom chords at the rear end of the boom section. A similar pair of plates extend between the lower pair of boom chords at the rear end of the boom section. Appropriately mounted in each set of plates are a pair of rear frame plates having openings generally aligned with their corresponding boom chord pins for receiving the outer ends of their respective chord pins which are carried on the inner of the two boom sections. A pair of front retainers mounted at the forward end of the outer boom section also act as boom stops to limit travel of the boom assembly to an extended position.

Limit switches associated with the respective adjacent sections of the boom assembly activate the mechanisms associated with the latch means for extension of the boom assembly. When the appropriate circuit has been actuated, the linear motor of the boom extension apparatus moves forwardly until a limit switch is engaged to stop the forward movement of the cylinder. When the forward movement of the motor is stopped, the chord pin cylinder mechanisms are axially aligned with the chord pins and the latching pins are axially aligned with the tubes provided in the inner boom section. The latching pin cylinder mechanisms are then actuated to extend the latching pins into the tubes in the inner boom section. When the latching pins are in place the chord pin mechanisms withdraw the chord pins from their respective openings in the outer boom section.

Once the chord pins are removed, the inner boom section is ready to be extended. The linear motor is actuated to extend the boom section until the front retainers are engaged to halt the outward travel of the boom section. When the front retainers are engaged by the shoulders of the chord pin sleeves carried by the moving inner boom section, the chord pins associated with the sleeves are aligned with holes provided in front retainers in the upper end of the stationary outer boom section of the pair. The hydraulic cylinders associated with the chord pins may be then actuated to insert the pins into these holes or openings to latch the two boom sections together in the extended position.

With the chord pins in place, the boom sections are locked in the extended position. The latching pins can then be withdrawn and the hydraulic cylinder retracted to its initial position from which the foregoing cycle can be repeated to extend and lock successive telescoping sections of the boom assembly using only the single latching mechanism and the single linear motor provided therewith. The rectangular cylinder guide provided around the linear motor supports the cylinder end of the linear motor and also keeps the cylinder from rotating so that the latching pin mechanisms and the chord pin mechanisms of the latch means are always properly aligned with their respective pins or openings.

Other features and advantages of the present invention will be apparent to persons skilled in the art from the following detailed description of a preferred embodiment and a second embodiment and accompanied by the attached drawings wherein identical reference numerals will refer to like parts in the various views.

BRIEF DESCRIPTION OF THE DRAWINGS

FIG. 7 is a side elevational view of a telescopic boom assembly incorporating a second embodiment of the extension and retraction apparatus of the present invention, the view being schematic in that certain portions of the boom assembly are removed for clarity and the boom assembly is shown in broken sections;

FIG. 8 is an exploded side elevational view of the boom assembly of FIG. 7;

FIG. 11 is a sectional view taken generally along line 11—11 of FIG. 7; and

FIG. 12 is a sectional view taken generally along line 12—12 of FIG. 11.

DESCRIPTION OF THE PREFERRED EMBODIMENT

Figure 1:
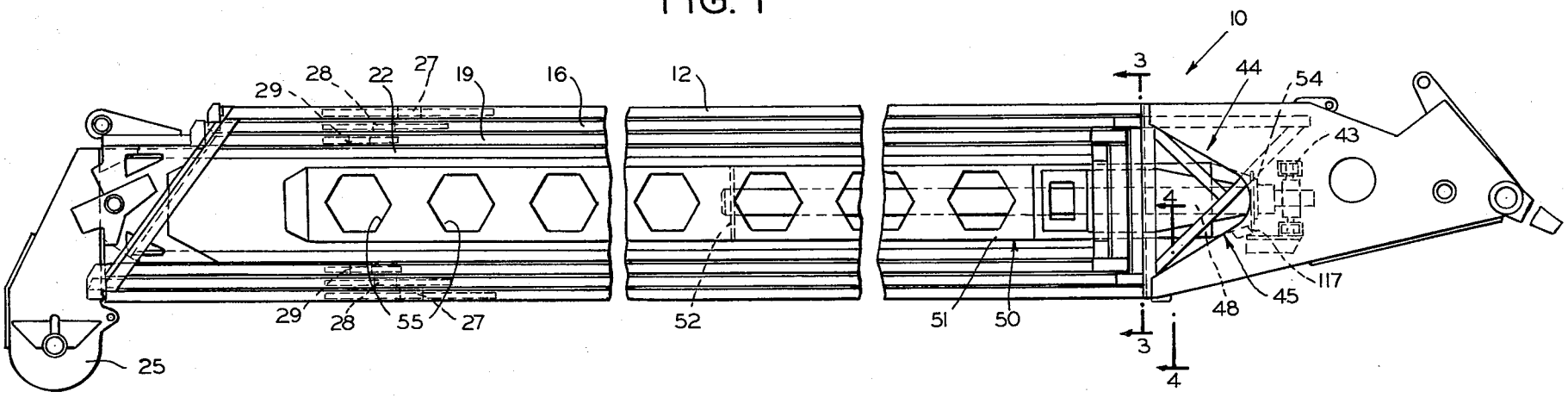
FIG. 1 is a side elevational view of a telescoping boom assembly incorporating the preferred embodiment of the extension and retraction apparatus of the present invention, the view being schematic in that certain portions of the boom assembly are removed for clarity and the boom assembly is shown in broken sections.

Referring to FIG. 1, reference number 10 generally designates a telescoping boom assembly pivotally mountable on a large mobile material handling apparatus such as a crane.

The boom assembly 10 comprises a plurality of extensible and retractable longitudinal sections, generally rectangular in cross-section, and nested within each other. The boom sections are similarly constructed; for example, the boom assembly 10 includes a boom base section 12 comprising longitudinal chord members 14*a*, 14*b*, 14*c* and 14*d* (FIG. 3) provided at the corners thereof. Lateral braces, such as braces 15*a*, 15*b*, 15*c* and 15*d* extend between adjacent chords of the boom base section and are normally welded in place. The lateral braces are arranged in a lattice type configuration to improve the structural integrity of the boom sections. In a telescoping boom assembly, the sections are correspondingly proportioned to slide into each other.

The boom assembly 10 comprises a boom base section 12, a main boom section 16, an intermediate boom section 19, and a power outer or fly section 22 carrying a nose assembly 25. The boom assembly 10 is extended and retracted by the preferred embodiment of the apparatus of the present invention as shown in FIGS. 1–6 and described herein.

Figure 2:
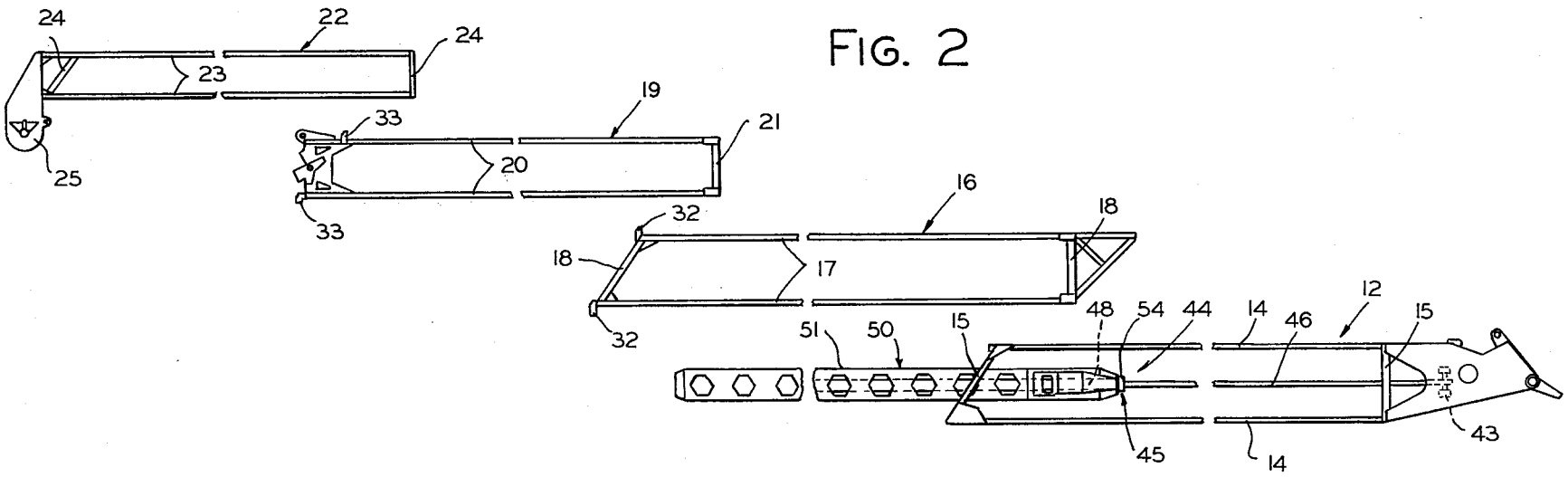
FIG. 2 is an exploded side elevational view of the boom assembly of FIG. 1.

As seen in FIG. 2, the boom base section 12 comprises longitudinal chords 14 retained in position by spaced lateral braces, such as braces 15, seen at opposite ends of the boom base section 12 (intermediate braces 15 omitted for clarity). Similarly the main boom section 16 comprises longitudinal chords 17 retained in position by spaced lateral braces 18; the intermediate boom section 19 comprises longitudinal chords 20 retained in position by spaced lateral braces 21; and the fly section 22 comprises longitudinal chords 23 retained in position by spaced lateral braces 24. Additionally rear frame retainer plates 26*a*, 26*b*, 26*c* and 26*d* (FIG. 3) are provided at the rear or lower end of the boom base section 12, secured to lateral braces 15*a* and 15*c* as well as respective chords 14 of the boom section 12, the plates 26*a* and 26*b* being secured to upper braces 15*a* and chords 14*a* and 14*b*, respectively, and the plates 26*c* and 26*d* being secured to lower lateral braces 15*c* and chords 14*c* and 14*d*, respectively. A set of front retainers 27 are symmetrically disposed at the front end of the boom base section 12 in front braces 15. Similar front retainers 28 and 29 and rear plates 30 and 31 (FIG. 5) are mounted at opposite ends of respective boom sections 16 and 19. Further, stops 32 and 33 are provided on respective outer ends of boom sections 16 and 19 as shown in FIG. 1. The front retainers 27 mounted on the boom base section 12 also act as boom stops as will be described in detail below.

Within the boom base section 12 of the boom assembly 10 is carried a mounting bracket 43 as shown in hidden lines in FIG. 1. The mounting bracket 43 retains one end portion of a boom extension and retraction apparatus 44. The boom extension and retraction apparatus comprises a fluid driven linear motor 45 having an outer end of portion 46 suitably secured as by bolts to the mounting bracket 43 associated with the boom base section 12. A cylinder portion 48 of the fluid driven linear motor 45 is mounted within a central core 51 of a cylinder guide 50, both core and cylinder guide being of generally rectangular configuration, the cylinder supported therein by a support 52 at an outer end portion thereof as shown in FIG. 1. The cylinder guide 50 is slidably mounted within the innermost or fly section 22 of the boom assembly 10, the rectangular configuration of the cylinder guide 50 severely restricting the rotation of the cylinder 48 and other mechanisms associated with the extension apparatus 44. A collar 54 of the cylinder guide 50 surrounds the cylinder of the fluid operated linear motor 45 at the rear or inner end thereof. A series of hexagonal cutouts 55 are provided in spaced relation along the sides of the core 51 of the cylinder guide 50 as best shown in FIGS. 1 and 2.

Figure 3:
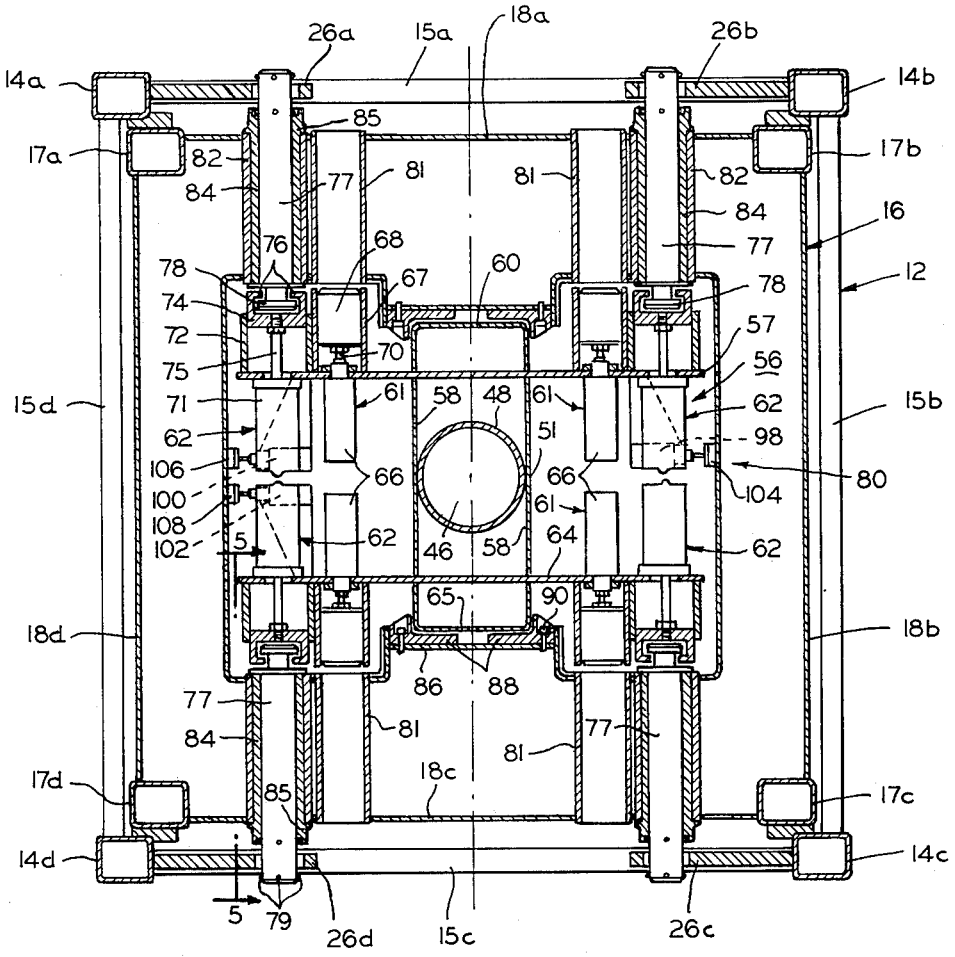
FIG. 3 is a sectional view taken generally along line 3—3 of FIG. 1.

As shown most clearly in FIG. 3, an extension and retraction mechanism 44 of the present invention comprises the cylinder guide 50 which supports the cylinder portion 48 of the linear motor 45 at the central rectangular portion or core 51 thereof. A cross plate 57 of a collar assembly or frame 56 intersects side walls 58 of the central core 51 of the cylinder guide 50 somewhat below the top wall 60 of the central core 51. The cross plate 57 is welded in place. Cantilever mounted on the cross plate 57 are a pair of latching pin cylinder mechanisms 61, each mechanism 61 of the pair adjacent a respective side wall 58 of the core 51 of the cylinder guide 50. The latching pin cylinder mechanisms 61 lie outside the central core 51 and are symmetrically disposed on opposite sides of the vertical centerline of the cross section shown in FIG. 3. Also mounted on the cross plate 57 are a pair of hydraulically actuated chord pin cylinder mechanisms 62 symmetrically disposed with respect to the vertical centerline and lying outboard of the latching pin cylinder mechanisms 61. Similarly, a lower plate 64 substantially parallel to the plate 57 intersects side walls 58 of the central core 51 of the cylinder guide 50 at a lower portion thereof as viewed in FIG. 3 and adjacent a bottom wall 65 of the core 51. A second pair of latching pin cylinder mechanisms 61 are mounted on the plate 64 outside the central core 51, adjacent respective side walls 58 and symmetrically disposed on either side of the vertical centerline for the cross-section of the cylinder guide 50. Also mounted on the plate 64 are a second pair of chord pin cylinder mechanisms 62 also symmetrically disposed on either side of the vertical centerline of the cylinder guide cross-section and mounted outboard of the latching pin cylinder mechanism 61.

Each of the latching pin cylinder mechanisms 61 comprises a cylinder portion 66 disposed, for example, on an inner side of the plate 57, a retaining sleeve 67 vertically aligned with the cylinder 66 and welded to the outer side of the plate 57, a latching pin 68 carried within the sleeve 67 and connected to the cylinder 66 by a connecting rod 70 passing through a suitable opening in the plate 57 and provided with fasteners for securing the cylinder 66 and the latch pin 68 in operable connecting relationship.

Each of the chord pin cylinder mechanisms 62 comprises a chord pin cylinder 71 mounted on an inner side of a cross plate, for example, the cross plate 57, and a sleeve 72 vertically aligned with the cylinder 71 and welded to the other side of the plate 57 outboard of the sleeve 67 of the latching pin cylinder mechanism 61. A gripping head 74 of the mechanism 62 travels within the sleeve 72 and is connected to the cylinder 71 by a connecting rod 75 appropriately joining the cylinder 71 and the gripping head 74 of the chord pin cylinder mechanism 62. The gripping head 74 includes turned-in flanges 76, enabling the gripping head to slide over a grooved head portion 78 of an outwardly extending chord pin 77.

Figure 6:
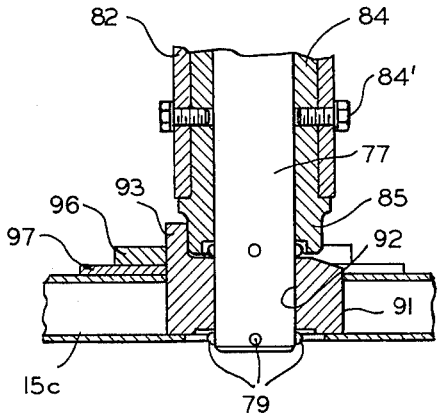
FIG. 6 is a detail sectional view taken generally along the line 6—6 of FIG. 4.
Figure 4:
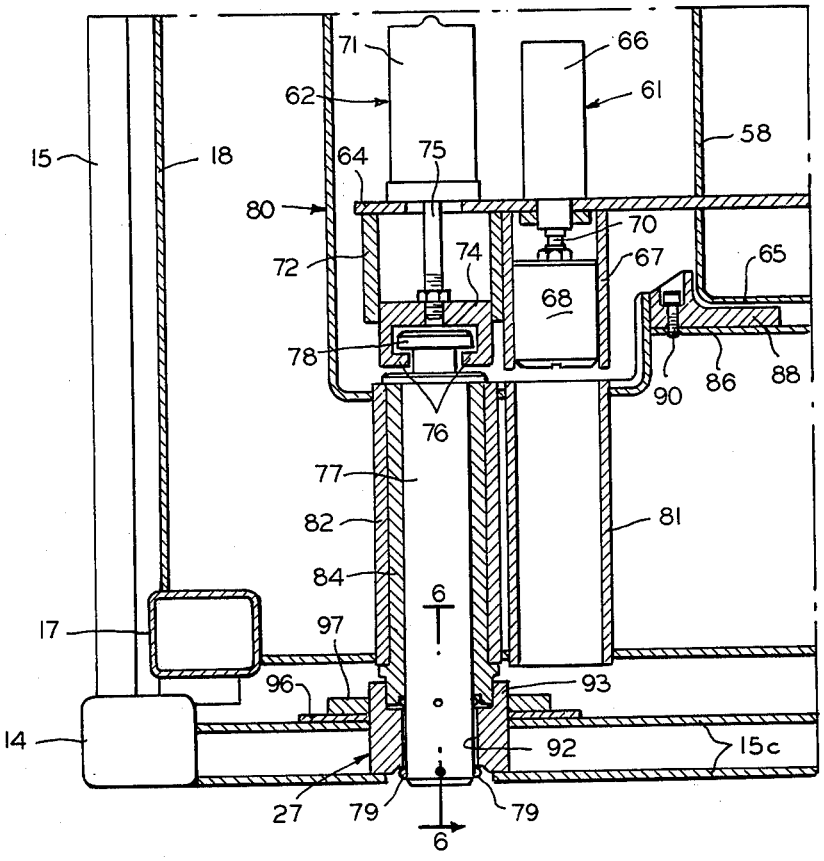
FIG. 4 is a partial sectional view showing a portion of a pair of adjacent sections of the boom assembly of FIG. 1, the sections being in the extended position.

In FIG. 3, four chord pins 77 extend outwardly to hold the boom base section 12 and the main boom section 16 in interlocking relationship in the fully retracted position. The main boom section 16 is a rectangular section having longitudinal chord members 17 at the corners of the rectangular cross section as shown in FIG. 3, the chords indicated as 17*a*, 17*b*, 17*c* and 17*d* clockwise from left. Lateral lacings or braces 18 secure the longitudinal chords 17 in assembled relationship as shown by lateral braces 18*a*, 18*b*, 18*c* and 18*d* in FIG. 3. At the lower end of the boom section 16 is provided an internal framework associated with the apparatus 44 for extension and retraction of the boom assembly 10 as well as for locking the boom assembly 10 in position. The lower framework for the main boom section 16 comprises lateral braces 18 as well as an inner frame 80. Latching pin retainer tubes 81 and chord pin retainer tubes 82 are welded between lateral braces 18 and the inner frame 80 to secure the inner frame 80 in place. Additionally, there is provided in the chord pin retainer tube 82, a chord pin sleeve 84 having an inner end coextensive with the inner end of the chord pin tube 82 and having a stepped shoulder 85 at its outer end which protrudes below its respective brace 18. The sleeves 84 are held in place as by fasteners 84' (FIG. 6). The tubes 81 are aligned with their respective latching pin cylinder mechanisms 61 and the chord pin retainer tubes 82 are aligned with their respective chord pin cylinder mechanisms 62 when the boom assembly 10 is in the fully retracted position and the boom extension and retraction apparatus 44 is aligned for extension of the boom section 16.

Inboard of the upper and lower latching pin tubes 81, for example, lower tubes 81*c* and 81*d* in FIG. 3, the frame 80 takes an inward step 86. Suitably secured to step 86 as by screws 90 are a pair of support members 88 which form a cradle for the central core 51 of the cylinder guide 50. In the fully retracted interlocking position the chord pins 77 are inserted in openings provided in retainer plates 26 mounted in the lateral braces 15 of the boom base section 12.

Retainer plates 26 are secured between adjacent braces, such as the braces 15*a* extending between chords 14*a* and 14*b* of the boom base section 12. The retainer plates 26 are welded in place in the braces 15 with their respective openings in substantial alignment with chord pins 77 and their associated chord pin cylinder mechanisms 62. Similar retainer plates 30 and 31 are provided on the rear ends of respective boom sections 16 and 19. Front retainers 27 are mounted at the forward end of the boom section 12 to receive the chord pins 77 when the boom section 16 is fully extended. Each of the retainers 27 comprises a main body portion 91 having a central cylindrical opening 92 for receiving the pin 77 and an upper body portion or stop 93 which is open at a rear edge. The upper portion 93 of the retainer 27 cooperates with the shoulder portion 85 of the chord pin sleeve 84 to act both as a stop and a self-aligning feature for the chord pins 77. Additional reinforcements or gusset plates 96 and 97 are welded behind the upper portion 93 of the retainer 27 to insure the integrity of the stop feature of the retainer member 27. Similar retainers or stops 28 and 29 are provided on forward ends of respective boom sections 16 and 19.

Each chord pin 77 includes a snap retainer 79 at a lower end which engages a lower edge of the retainer plate 26 or the retainer 27 to hold the pin 77 inserted therein in place.

Limit switches 98, 100 and 102 are provided on the cylinder guide 50 and associated cams 104, 106 and 108 are provided on respective extensible boom sections 16, 19 and 22. When a limit switch is activated by the cam associated with the respective boom section, latch pin cylinder mechanisms 61 and chord pin cylinder mechanisms 62 of the boom extension and retraction assembly 44 are aligned with respective openings and chord pins of the associated boom sections. The relationship may be understood more clearly by viewing FIG. 5 in conjunction with FIG. 3.

Figure 5:
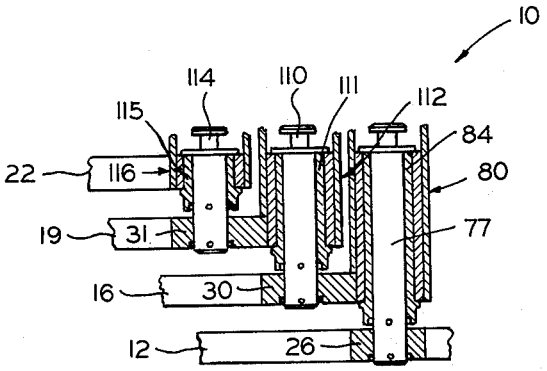
FIG. 5 is a sectional view taken generally along the line 5—5 of FIG. 3.

FIG. 5 is a sectional view looking at the lower end of the fully retracted and interlocked boom assembly 10. In FIG. 5 the fully extended chord pin 77 mounted in the chord pin sleeve 84 of the lower frame 80 of the main boom section 16 is inserted into the opening in the retainer plate 26 in the boom base section 12. A similar pin 110, shorter than the chord pin 77, mounted in a chord pin sleeve 111 of a frame assembly 112 for the intermediate boom section 19 is received in the opening in the retainer plate 30 provided in the main boom section 16 to interlock main boom section 16 and intermediate boom section 19. A third chord pin 114, which is a shorter version of chord pin 110, interlocks fly section 22 and intermediate section 19. The chord pin 114 is carried in a chord pin sleeve 115 mounted in a rear frame assembly 116 of fly section 22. Pin 114 is received in the opening in the retainer plate 31 mounted in the intermediate section 19 to interlock sections 19 and 22. Front retainer 29 mounted on the front end of intermediate section 19 stops the outward travel of the fly section 22. Thus, no retainer is required on the fly section 22.

To illustrate the operation of the limit switches 98, 100 and 102, for example, when the limit switch 102 strikes its associated cam 108 the chord pin cylinder mechanisms 62 are aligned with chord pin 114 mounted in fly section 22. Limit switch 100 strikes cam 106 to align the chord pin cylinder mechanisms 62 with chord pins 110 mounted in the intermediate section 19 and limit switch 98 strikes cam 104 to align the chord pin cylinder mechanisms 62 with the chord pins 77 mounted in main boom section 16. The respective gripping head portions of chord pins 77, 110 and 114 are substantially aligned with each other as shown in FIG. 5. This enables the single group of chord pin mechanisms 62 to engage any of the groups of chord pins associated with their respective boom sections.

Although the following sequence describes the extension and retraction of boom section 16 with respect to the boom base section 12, it should be understood that the extension and retraction method is similar for all interconnected telescopic sections. It should further be noted that full extension of the telescoping boom assembly can only be achieved by extension of innermost sections first, that is, by extending innermost section 22, which is next to the cylinder guide 50, first, followed by extension of section 19 and then extension of section 16. Retraction is achieved in the reverse order. The extension of main boom section 16 with respect to boom base section 12 is achieved as follows.

OPERATION OF THE PREFERRED EMBODIMENT

With the boom assembly 10 in the fully retracted position, the fluid driven linear motor 45 of the extension and retraction apparatus 44 of the present invention is located at the position shown in FIG. 1. A switch provided in the cab of the crane for the hydraulic circuit associated with the apparatus 44 of the present invention is closed to actuate the linear motor 45 to initiate a forward extension thereof along with the associated cylinder guide 50. After the switch is actuated, the linear motor 45 extends the cylinder guide 50 until a limit switch 98 mounted on the cylinder guide 50 engages a cam 104 mounted on the main boom section 16 of the boom assembly 10. The engagement of the limit switch 98 with cam 104 stops the initial extension of the motor 45 to align the gripping heads 74 of the chord pin cylinder mechanisms 62 with the chord pin 77 of the main boom section 16. Gripping flanges 76 slip into grooves beneath the grooved heads 78 of the chord pins 77. Further, latching pins 68 associated with the latching pin cylinder mechanisms 61 are aligned with the latching pin tubes 81 of the main boom section 16.

With the apparatus 44 properly aligned with respect to the main boom section 16, the respective latching pin cylinders 66 are actuated to extend the latching pins 68 into the latching pin tubes 81 of the main boom section 16 to couple the cylinder 45 thereto. With the latching pins 68 in place the chord pin cylinders 71 are actuated to withdraw the chord pins 77 from the openings in rear frame retainer plates 26 provided at the rear of the boom base section 12. With the chord pins 77 removed from the openings in the rear plates 26, the chord pin sleeves 84 are free to slide forward. If desired, microswitches may be provided on the latch apparatus 44 adjacent the chord pin mechanisms 62 and in engagement with the chord pins 77 to indicate when the chord pins 77 have been fully withdrawn from the rear plates of the boom section. When a switch (not shown) is actuated in the cab of the vehicle the main boom section 16 moves outwardly. The main boom section 16 is extended until the shoulders 85 of the chord pin sleeves 84 engage the stops 93 of the front retainers 27 provided on the front end of the boom base section 12 of the boom assembly 10.

When the shoulder 85 of the sleeves 84 have engaged the stops 93 of the front retainers 27 of the boom base section 12, the chord pins 77 of the main boom section 16 are aligned with the openings provided therein. The chord pin cylinders 71 are then actuated outwardly to insert the chord pins 77 carried by the main boom section 16 into the front retainers 27 to retain the main boom section 16 and the boom base section 12 in the fully extended position. Snap retainers 79 of the chord pins 77 each engage a lower peripheral edge of a front retainer 27 of the boom base section 12.

With the chord pins 77 in place, the latching pins 68 may be withdrawn from the latching pin retainer tubes 82 and the motor 45 may be returned to the fully retracted position of FIG. 1. As the motor 45 is retracted an inner end on the cylinder 46 engages a limit switch 117 provided on the mounting bracket 43 of the boom assembly 10 to provide a safety stop for the linear motor 45.

To retract the boom section 16, the hydraulic cylinder 45 is extended until the limit switch 98 engages the cam 104, aligning the gripping heads 74 of the mechanisms 62 with the chord pins 77 and the latching pins 68 with the tubes 81.

With the latch apparatus properly aligned, the latching pins 68 are inserted into the tubes 81 and the chord pins are withdrawn from the openings in the retainers 27. With the chord pins 77 withdrawn, the cylinder 45 may be retracted to return the main boom section 16 to the fully retracted position. Front stops 32 provided on respective upper and lower portions of the forward end of the main boom section 16 engage the forward end of the boom base section 12 to limit the rearward travel of the main boom section 16.

The hydraulic circuit controlling the mechanism 44 may be of relatively simple configuration comprising a single two-position, four-way solenoid valve controlling the four latching pin mechanisms 61 and a similar valve controlling the four chord pin mechanisms 62.

To extend additional sections of the boom assembly 10, switches provided in the cab of the hydraulic crane and associated with the hydraulic circuit controlling the latching apparatus 44 are actuated to extend the remaining boom sections in like manner to that used to extend the main boom section 16 with respect to the boom base section 12 of the boom assembly 10. Note, however, that the effective extensible length of the apparatus described herein is one boom section and that the boom sections of the telescoping boom assembly are interlocked in stacked relationship. To extend more than one boom section the boom sections must be extended sequentially, that is, from the innermost to the outermost section. If one of the outer sections 16 or 19 were extended first, the inner section 22 would be carried within the outer section 16 or 19, beyond the effective range of the extension apparatus 44. The design provides that the inner or fly section is pinned or latched within the outer section when the boom is in the retracted position.

DESCRIPTION OF AN ALTERNATIVE EMBODIMENT OF THE PRESENT INVENTION

A second embodiment of the present invention comprises a second boom extension and retraction apparatus 120 suitably mounted in the boom assembly 10. Slight modifications must be made in the boom assembly 10 to accommodate the mechanism 120, but like parts for the two embodiments shall have like reference numerals.

Welded in place on chords 14 of the boom base section 12 are chord pin retainers 121 at a rear or inner end of the boom base section 12 and chord pin retainers 122 at a front or outer end of the boom base section 12 in the chords 14. Chord pin retainers 123 are mounted in chords 17 of the main boom section 16 at a rear end thereof and chord pin retainers 124 are mounted in the chords 17 of the main boom section 16 at a front end thereof. Chord pin retainers 125 are mounted at a rear of the boom intermediate section 19 in the chords 20 thereof, and chord pin retainers 126 are mounted at the front ends of chords 20 of the intermediate boom section 19.

Additionally, as shown in FIG. 8, boom stops are provided on the side of the boom sections 12, 16, 19 and 22. For example, boom stops 127 are provided at a rear or lower end of the boom base section 12 and boom stops 128 are provided at a front or upper end of the boom base section 12. Boom stops 130 are provided at a rear end of the main boom section 16 and boom stops 132 are provided at a front end of the main boom section 16. Boom stops 133 are provided at a rear end of the boom intermediate section 19 and boom stops 134 are provided at a front end of the boom intermediate section 19. Stops 135 are provided at the rear end of the fly section 22. Stops 127 and 128 are carried on the interior of the boom base section 12. Similarly mounted on the interior of their respective boom sections are front stops 132 of the main boom section 16 and front stops 134 of the intermediate boom section 19. Mounted on the exterior of their respective boom sections are rear stops 130, 133 and 135 of boom sections 16, 19 and 22, respectively. All boom stops are of complementary triangular configurations.

The boom extension and retraction apparatus 120 includes a fluid driven linear motor 45 having an outer end of its rod portion suitably secured as by bolts to the mounting bracket 43 provided in the boom base section 12. The cylinder portion 48 of the fluid driven linear motor is mounted within a central core 151 of a cylinder guide 150, both core and cylinder guide being of generally rectangular configuration, the cylinder supported therein by a support 152 at an outer end portion thereof as shown in FIG. 7. The cylinder guide 150 is slidably mounted within the innermost or fly section 22 of the boom assembly 10, the rectangular configuration of the cylinder guide 150 severely restricting the rotation of the cylinder 48 and other mechanisms associated with the extension apparatus 120. A collar 154 of the cylinder guide 150 surrounds the cylinder of the fluid operated linear motor at the inner end thereof. A series of hexagonal cutouts 155 are provided in spaced relation along the sides of the core 151 of the cylinder guide 150 as best shown in FIGS. 7 and 8.

Figure 9:
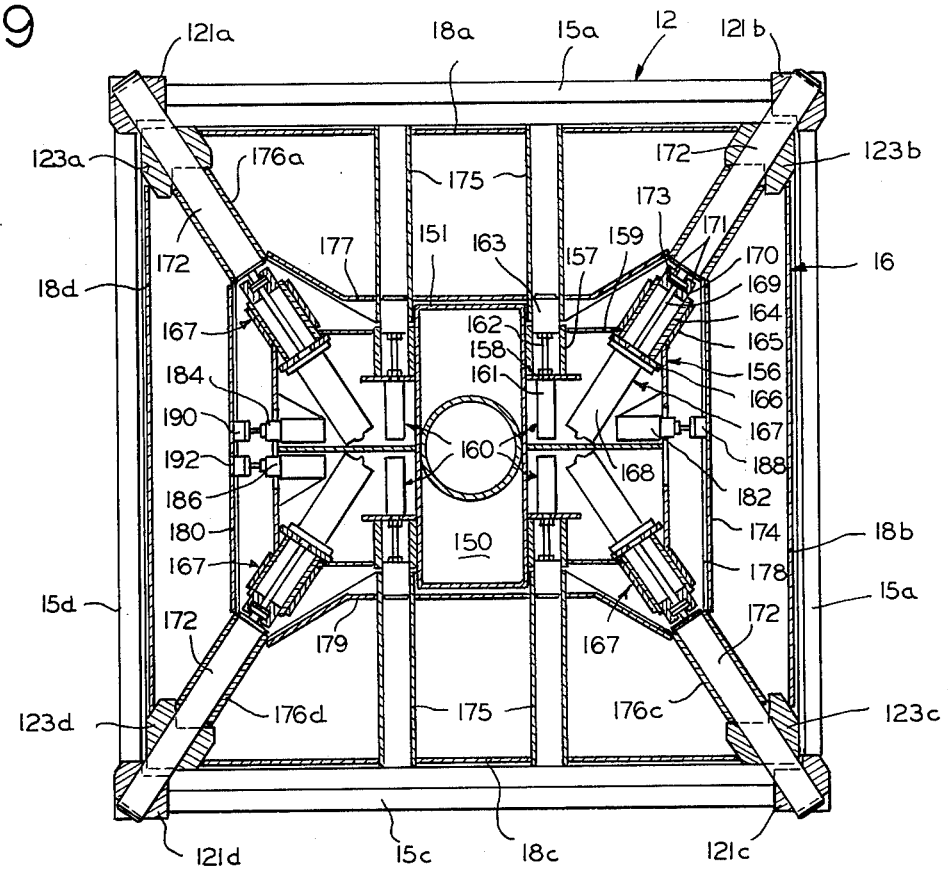
FIG. 9 is a sectional view taken generally along line 9—9 of FIG. 7.
Figure 10:
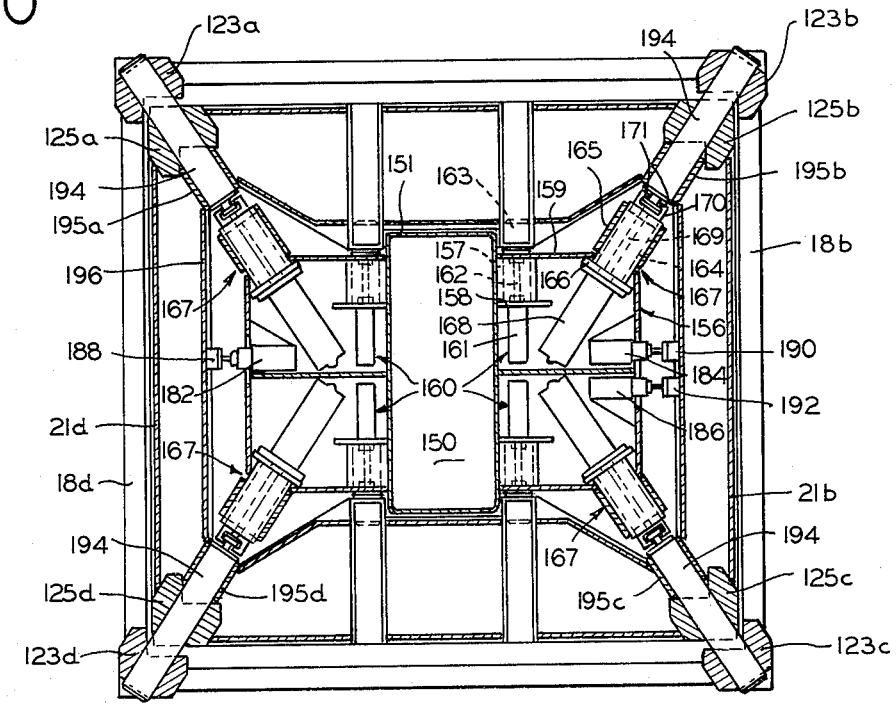
FIG. 10 is a sectional view taken generally along line 10—10 of FIG. 7.

As shown most clearly in FIGS. 9 and 10, the extension and retraction apparatus 120 of the present invention comprises the cylinder guide 150 which supports the cylinder portion 48 of the linear motor 45 at the central rectangular core 151 thereof. A rectangular frame 156 partially encloses the central rectangular portion 151 of the cylinder guide 150. The frame 156 includes a pair of retaining sleeves 157 welded to opposite sides of the rectangular portion 151 of the cylinder guide 150 at an upper end thereof. A pair of sleeves 157 are also welded on opposite sides of a lower end of the core 151. Plates 158 close the inboard ends of the retaining sleeves 157. Secured to the outboard end of the retaining sleeves 157 at an outer peripheral edge thereof and extending outwardly perpendicularly therefrom are portions 159 of the lower frame 156 of the cylinder guide 150. Suitably mounted on the closing plates 158 are latching pin cylinder mechanisms 160, comprising a latching pin cylinder 161 mounted on the inboard side of the closing plate 158, a connecting rod 162 lying on the outboard side of the closing plate 158 and suitably connected therethrough to the latching pin cylinder 161, the outer end of the connecting rod 162 suitably secured to a latching pin 163, which is slidably movable in the sleeve 157.

Diagonally mounted at each of the four corners of the frame 156 is a chord pin sleeve 164. The chord pin sleeve 164 is welded in place and has an outer holding tube 165 surrounding the chord pin sleeve 164 and also welded in place on the frame 156. A closing plate 166 closes the inboard end of the chord pin sleeve 164 and serves as a mounting means for a chord pin cylinder 168 of a chord pin mechanism 167. A connecting rod 169 extends into the sleeve 164 and extends through an opening in the plate 166 to be suitably connected to the chord pin cylinder 168 at an inboard end thereof. The connecting rod 169 carries at its outboard end a gripping head 170 having inwardly directed tangs or flanges 171 for engaging the grooved gripping head 173 of a chord pin 172.

In FIG. 9, four chord pins 172 extend diagonally outward to hold the boom base section 12 and the main boom section 16 in interlocking relationship. The main boom 16 comprises chord members 17 and lateral braces 18. An interior frame 174 of the main boom section 16 is provided at a rear end portion thereof, the interior frame 174 being connected to the outer lateral braces 18 by latching pin receiver tubes 175 and chord pin receiver tubes 176. The tubes 175 and 176 are welded in place between the lateral braces 18 and the interior frame 174 in substantial alignment with corresponding latching pin cylinder mechanisms 160 and chord pin cylinder mechanisms 167 associated with the cylinder guide 150 of the boom extension and retraction apparatus 120. The latching pin retainer tubes 175 are mounted in upper and lower pairs and extend substantially vertically as shown in FIG. 9, with the upper tubes 175 extending between a lateral brace 177 of the frame 174 and the lateral brace **18*a* of the main boom section 16 and the lower tubes extending between a lateral brace 179 of the frame 174 and the lower lateral brace 18*c* of the main boom section 16. Chord pin retainer tubes 176 are secured between chords 17 of the main boom section 16 and the inner frame 174 of the main boom section 16. For example, chord pin retainer tube 176*b* is secured to retainer 123*b* mounted in chord 17*b* of the main boom section 16 at an outer end thereof, and secured at its inner end to frame members 177 and 178 of the inner frame 174 of the main boom section 16. Similarly, chord pin retainer tubes 176*a*, 176*c* and 176*b* are secured between respective retainers 123*a*, 123*c* and 123*d* mounted in chord members 17*a*, 17*c* and 17*d* and the inner frame 174, with the chord pin retainer tube 176*a* secured at its inner end to frame members 180 and 177, the chord pin retainer tube 176*c* secured at its inner end to frame members 178 and 179, and chord pin retainer tube 176*d* secured at its inner end to frame members 179 and 180.**

Limit switches 182, 184 and 186 are provided on the cylinder guide 150 and associated cams 188, 190 and 192 are provided on respective extensible boom sections 16, 19 and 22 when a limit switch is activated by the cam associated with the respective boom section, latching pin cylinder mechanisms 160 and chord pin cylinder mechanisms 167 of the boom extension and retraction assembly 20 are aligned with respective chord pins and openings of the associated boom sections. The relationship may be understood more clearly by viewing FIG. 11 in conjunction with FIG. 9. FIG. 11 is a sectional view looking at the lower end of the fully retracted and interlocked boom assembly 10. In FIG. 11 the fully extended chord pin 172 mounted in the chord pin sleeve 176 of the lower frame 174 of the main boom section 16 is inserted into the retainer 121 in the boom base section 12. A similar pin 194, shorter than the chord pin 172, mounted in a chord pin sleeve 195 of a frame assembly 196 for the intermediate boom section 19 is received in the retainer 123 provided in the main boom section 16 to interlock main boom section 16 and intermediate boom section 19. A third chord pin 197, which is a shorter version of the chord pin 194, interlocks fly section 22 and intermediate section 19. Chord pin 197 is carried in a chord pin sleeve 198 mounted in a rear frame assembly 199 of the fly section 22. Pin 197 is received in the retainer 125 mounted in the intermediate section 19 to interlock sections 19 and 22. The respective gripping head portions of chord pins 172, 194 and 197 are substantially aligned with each other. This enables the single group of chord pin mechanisms 167 to engage any of the groups of chord pins associated with their respective boom sections.

The sequence of operation for the second embodiment disclosed in FIGS. 7 through 12 is substantially similar to that of the Preferred Embodiment. That is, referring to FIG. 9, in the fully retracted position, to extend the main boom section 16 outwardly of the boom base section 12, latching pin cylinder mechanisms 160 extend latching pins 163 into the latching pin retainer tubes 175 of the main boom section 16. With the latching pin 163 in place the chord pin cylinder mechanisms 167 are actuated to retract chord pins 172 from chord pin retainers 121 mounted at the rear end of the boom base section 12. With latching pins 161 in place and with the chord pins 168 removed from the boom base section, the main boom section is free to move with respect to the boom base section 12. Accordingly, actuation of the hydraulic cylinder 45 carried the cylinder end of the linear motor 45 outwardly of the rod end thereof carrying along with it the main boom section 16.

The method of extension of the alternate embodiment of the present invention differs only in the manner in which the stops associated with the constituent boom sections are employed. For example, when the cylinder 45 carries the main boom section 16 forward, stops 130 on the exterior of the main boom section 16 are disengaged from rear interior stops 127 of the boom base section 12. The cylinder 45 carries the main boom section 16 forward until stops 130 engage front stops 128, also interiorly mounted, of the boom base section 12. When stops 130 engage front stops 128 chord pins 168 are aligned with the chord pin retainers 122 at the front end of the boom base section 12. When chord pins 172 are inserted into the chord pin retainers 122, boom sections 12 and 16 are locked in place in the fully extended position.

It should be noted that as in the preferred embodiment, the sequence of extension is from the smallest or innermost section to the largest or outermost section, or viewed from left to right in FIG. 8. That is, fly section 22 is extended until lower stops 135 engage outer stops 134 on the intermediate section 19, at which time the chord pins 197 are inserted into the retainers 126 on the intermediate section 19 to hold the fly section 22 and the intermediate section 19 locked in the fully extended position. The extension cycle of the mechanism 120 is then repeated to extend section 19 with respect to main boom section 16 with stops 133 of boom section 19 engaging outer stops 132 of the main boom section 16 when boom section 19 is in the fully extended position. Chord pins 194 are then inserted into retainers 124 on the main boom section 16 to hold the intermediate section 19 and the main boom section 16 locked together in the fully extended position. At this point the mechanism 120 is recycled to extend the main boom section 16 with respect to the boom base section 12 as described above.

Having thus described in detailed manner a preferred embodiment of the invention as well as a second embodiment thereof, persons skilled in the art will be able to modify certain of the structure that has been illustrated and to substitute equivalent elements for those that have been disclosed and it is therefore, intended that all such modifications and substitutions be covered as they are embraced within the scope of the appended claims.

We claim:

1. In a mobile material handling apparatus, such as a rotatable crane, having a telescoping crane boom assembly comprising a plurality of telescoping boom sections, apparatus for extending and retracting said boom assembly including:

a fluid pressure operated cylinder nested within the innermost telescoping section of the crane boom assembly, guide means mounted on a movable end portion of the cylinder to protectively enclose the cylinder and to maintain the orientation thereof with respect to the telescoping sections of the crane boom assembly, a plurality of means linearly aligned for locking respective adjacent movable sections of a telescoping crane boom assembly in assembled relation, and a latch mechanism mounted on the guide means, said latching mechanism comprising first latching means for engaging a boom section for extension and retraction thereof by means of the cylinder, and second latching means, distinct from the first latching means, for selectively and cooperatively engaging one of said boom locking means for locking and unlocking thereof to permit extension and retraction of a selected movable section of the boom assembly.

2. The extension and retraction apparatus as claimed in claim 1 wherein the boom assembly also includes means for limiting the extension of the boom sections beyond a predetermined fully extended position thereof.

3. The boom extension and retraction apparatus as claimed in claim 1 wherein the guide means comprises a central core enclosing the movable end portion of the cylinder, the guide means further comprising a collar assembly having a plurality of frame members forming an extension of the cylinder guide means, the collar assembly secured to an end portion of the central core of the cylinder guide for support thereof, and the collar assembly carrying the latch mechanism.

4. The boom extension and retraction apparatus as claimed in claim 1 wherein the nested boom sections are of substantially rectangular configuration, and the guide means secured to the cylinder nested within the innermost boom section is of substantially rectangular configuration to limit relative rotation with respect thereto.

5. The boom extension and retraction apparatus as claimed in claim 1 wherein the means for locking the movable sections of the boom assembly in assembled relation comprise retaining means mounted at opposite ends of an outer boom section, said retaining means having openings therein, and chord pins mounted on a next adjacent inner boom section of the telescoping boom assembly at a lower end thereof, said chord pins being extendible to engage the openings in the retaining means to secure adjacent boom sections in assembled relation.

6. The boom extension and retraction apparatus as claimed in claim 5 wherein the chord pins include snap retainers mounted at an outer end thereof, the snap retainers engaging a lower peripheral edge of the chord pin retaining means of the outer boom section when the chord pins are fully extended to lock adjacent boom sections in assembled relation.

7. The boom extension and retraction apparatus as claimed in claim 5 wherein the locking means further comprises a frame assembly mounted on a lower end of an inner boom section, the chord pins being carried in the frame assembly and extending outwardly therefrom to engage respective retaining means in the next adjacent outer boom section to lock the adjacent boom sections in assembled relation.

8. The boom extension and retraction apparatus as claimed in claim 7 wherein the frame assembly for the locking means comprises a tube mounted between respective inner and outer frame members of the frame assembly, a co-extensive sleeve carried in the tube, the sleeve receiving the chord pin therein, the sleeve having an enlarged shoulder extending below an outer surface of the inner boom section, the shoulder of the chord pin sleeve engageable with an upper protruding portion of a front retaining means provided in the next adjacent outer boom section, the shoulder of the chord pin sleeve and the protrusion of the retainer serving as a means for aligning the chord pin with the opening in the retainer.

9. The boom extension and retraction apparatus as claimed in claim 8 wherein front retaining means comprises a forward protruding portion thereof, the upper surface of the rear portion of the front retaining means being co-extensive with a lower surface of the enlarged shoulder portion of the chord pin sleeve, the front protrusion of the front retaining means acting as a stop means to limit travel of the next adjacent inner boom section in the direction of the extension.

10. The boom extension and retraction apparatus as claimed in claim 1 wherein the latch mechanism comprises a plurality of latching pin cylinder mechanisms symmetrically mounted on the cylinder guide, the latching pin cylinder mechanisms comprising respectively outwardly extensive latching pin portions cooperable with complementary receiving means provided in respective portions of the telescoping boom sections of the boom assembly.

11. The extension and retraction apparatus as claimed in claim 10 wherein the latching pin receiving means comprise complementary tubes mounted in frame assemblies provided in respective lower portions of each boom section of the telescoping boom assembly.

12. The extension and retraction apparatus as claimed in claim 10 wherein latching pin cylinder mechanisms are mounted on a collar assembly secured to an end portion of the cylinder guide.

13. A boom extension and retraction apparatus as claimed in claim 12 wherein each of the latching pin cylinder mechanisms comprise an extensible and retractable cylinder portion mounted on an inner surface of a respective frame portion of the collar assembly, a latching pin retainer sleeve mounted on an opposite or outer surface of the frame portion of the collar assembly aligned with the cylinder portion thereof, a connecting rod operatively connected to the latching pin cylinder at one end thereof and carrying on an opposite or outer end thereof a latching pin slidably movable in the latching pin sleeve of the latching pin cylinder mechanism.

14. A boom extension and retraction apparatus as claimed in claim 3 wherein the means for locking the movable sections of a telescoping crane boom assembly in assembled relation comprise retaining means mounted at opposite ends of an outer boom section, said retaining means having openings therein, chord pins mounted on a next adjacent inner boom section of the telescoping boom assembly at a lower end thereof, said chord pins being extendible to engage the openings in the retaining means to secure adjacent boom sections in assembled relation, the latch mechanism further comprising chord pin mechanisms symmetrically mounted on the collar assembly for insertion and withdrawal of respective chord pins associated therewith to permit locking and unlocking of the boom sections of the telescoping boom assembly.

15. The boom extension and retraction apparatus as claimed in claim 14 wherein the chord pin mechanisms each comprise an extensible and retractable cylinder mounted on an inner side of a respective frame portion of the collar assembly, a complementary chord pin sleeve aligned with the chord pin cylinder and mounted on an outer surface of the frame portion of the collar assembly, a connecting rod passing through an opening in the frame portion having one end portion secured to the cylinder and an outer end portion secured to a chord pin gripping means, the chord pin gripping means slidably movable in the chord pin sleeve.

16. The boom extension and retraction apparatus as claimed in claim 15 wherein the chord pin comprises an elongated pin having a snap retainer at an outer end thereof and having a grooved head portion at an inner end thereof, the chord pin gripping means further comprising a cylindrical member having an extensible tube portion at an outer end thereof, the tube portion having opposite side walls terminating in a pair of flange portions inwardly directed toward each other, the inwardly directed flanges and the side walls forming an internal cavity for receiving the head portion of the chord pin, the flange portion slidable into the grooved portion of the chord pin to place the inner surface of the flanges in engagement with the underside of the gripping head of the chord pin for effective withdrawal thereof.

17. In a mobile material handling apparatus, such as a rotatable crane, having a telescoping boom assembly comprising a plurality of telescoping boom sections, apparatus for extending and retracting said boom assembly including:

a fluid pressure operated cylinder nested within the innermost telescoping section of the crane boom assembly guide means mounted on a movable end portion of the cylinder to protectively enclose the cylinder and to maintain the orientation thereof with respect to the telescoping section to the boom assembly, said guide means comprising a central core enclosing the movable end portion of the cylinder and a collar assembly mounted at one end of the central core of the cylinder guide, said cylinder guide adapted to limit rotation of the cylinder guide relative to the boom assembly, a plurality of means linearly aligned for locking respective adjacent movable sections of the telescoping boom assembly in assembled relation including retaining means mounted at opposite ends of an outer boom section, said retaining means having openings therein, and chord pins mounted in a next adjacent inner boom section of the telescoping boom assembly at a lower end thereof, said chord pins being extendible to engage the openings in the retaining means to secure adjacent boom sections in assembled relation, and a latch mechanism mounted on the cylinder guide, said latch mechanism comprising, first latching means including a plurality of latching pin cylinder mechanisms symmetrically mounted on the collar assembly of the cylinder guide, said latching pin cylinder mechanisms including extendible latching pins engageable with complementary receiving means provided in lower end portions of respective boom sections of the boom assembly, the latching pins extendible into said receiving means for engagement therewith to permit extension and retraction of the boom section so engaged, by means of the cylinder, and second latching means, distinct from the first latching means, including a plurality of chord pin mechanisms symmetrically mounted on the collar assembly of the cylinder guide, the chord pin mechanisms cooperatively interacting with the latching pin mechanisms, the chord pin mechanisms ing gripping portions provided at an outer end thereof, the gripping portions of the chord pin mechanisms being selectively engageable with respective chord pins for engagement and disengagement thereof, the disengagement of the chord pins from their respective retaining means permitting selective extension and retraction of an inner section of an adjacent pair of boom sections of the boom assembly.

* * * * *